US010806232B2

(12) United States Patent
Jung et al.

(10) Patent No.: US 10,806,232 B2
(45) Date of Patent: Oct. 20, 2020

(54) DROPPER-TYPE COSMETICS CONTAINER

(71) Applicant: LG Household & Health Care Ltd., Seoul (KR)

(72) Inventors: Jae Hong Jung, Seoul (KR); Hye Jin Lee, Seoul (KR); Yong Joon Jang, Seoul (KR); Hyo-Sun Jung, Incheon (KR); Kang-Jin Lee, Incheon (KR); Woong-Hee Lee, Incheon (KR); Seok-Gi Choi, Incheon (KR)

(73) Assignee: LG Household & Health Care Ltd. (KR)

( * ) Notice: Subject to any disclaimer, the term of this patent is extended or adjusted under 35 U.S.C. 154(b) by 0 days.

(21) Appl. No.: 16/473,112

(22) PCT Filed: Sep. 29, 2017

(86) PCT No.: PCT/KR2017/010950
§ 371 (c)(1),
(2) Date: Jun. 24, 2019

(87) PCT Pub. No.: WO2018/124434
PCT Pub. Date: Jul. 5, 2018

(65) Prior Publication Data

US 2019/0343261 A1 Nov. 14, 2019

(30) Foreign Application Priority Data

Dec. 29, 2016 (KR) ..... 10-2016-0182874

(51) Int. Cl.
*B01L 3/02* (2006.01)
*A45D 34/04* (2006.01)
*B65D 47/18* (2006.01)

(52) U.S. Cl.
CPC ..... *A45D 34/04* (2013.01); *B65D 47/18* (2013.01)

(58) Field of Classification Search
CPC ..... B01L 3/0282; B01L 3/0272; A45D 34/04; A45D 2200/055; B65D 47/18
(Continued)

(56) References Cited

U.S. PATENT DOCUMENTS 1,203,919 A * 11/1916 Simpson ..... B01L 3/0282 141/24
2,845,963 A * 8/1958 Zackheim ..... B65D 23/00 141/24
(Continued)

FOREIGN PATENT DOCUMENTS

JP 5938828 B2 6/2016
KR 20130062124 A 6/2013
(Continued)

OTHER PUBLICATIONS

Search report from International Application No. PCT/KR2017/010950, dated Jan. 17, 2018.

*Primary Examiner* — Charles Cheyney
(74) *Attorney, Agent, or Firm* — Lerner, David, Littenberg, Krumholz & Mentlik, LLP

(57) ABSTRACT

The present invention relates to a dropper-type cosmetic container, which is configured so that in a process of releasing screw-coupling to a container main body by rotating a closing cap, by frictional force between an inner circumferential surface of a content inflow tube and an outer circumferential surface of a dropper pipe, the contents stored in the container main body pass through a content inflow hole forming a narrow channel, are dispersed, and are sucked into the dropper pipe, thereby allowing the contents to be drawn into the interior of the dropper pipe through a simple sucking structure to be used.

8 Claims, 8 Drawing Sheets

(58) Field of Classification Search
USPC ..... 222/207, 420; 141/24, 23, 22
See application file for complete search history.

(56) References Cited

U.S. PATENT DOCUMENTS

| | | | | | |
|---|---|---|---|---|---|
| 2,877,810 | A * | 3/1959 | Zackheim | B01L 3/0282 | 141/24 |
| 3,881,624 | A * | 5/1975 | Dougherty, Sr. | B65D 50/046 | 215/221 |
| 3,888,251 | A * | 6/1975 | Harrison | A61F 9/0008 | 604/301 |
| 4,383,618 | A * | 5/1983 | Dougherty | B65D 50/046 | 215/216 |
| 4,633,922 | A * | 1/1987 | Fabbro | B65D 41/48 | 141/24 |
| 4,671,330 | A * | 6/1987 | Miles | G01F 11/082 | 141/24 |
| 5,746,349 | A * | 5/1998 | Putteman | A61J 1/2096 | 222/49 |
| 7,905,673 | B2 | 3/2011 | Swaile et al. | | |
| 9,289,788 | B2 * | 3/2016 | Beranger | B05B 11/048 | |
| 2008/0029180 | A1 * | 2/2008 | Barone | B65D 47/18 | 141/24 |
| 2013/0032242 | A1 * | 2/2013 | Beranger | A45D 34/04 | 141/23 |

FOREIGN PATENT DOCUMENTS

| | | | |
|---|---|---|---|
| KR | 20130101176 | A | 9/2013 |
| KR | 200480441 | Y1 | 5/2016 |

* cited by examiner

DROPPER-TYPE COSMETICS CONTAINER

CROSS-REFERENCE TO RELATED APPLICATIONS

This application is a national phase entry under 35 U.S.C. § 371 of International Application No. PCT/KR2017/010950, filed Sep. 29, 2017, which claims priority to Korean Patent Application No. 10-2016-0182874, filed Dec. 29, 2016.

TECHNICAL FIELD

The present invention relates to a dropper-type cosmetic container, and more particularly, to a dropper-type cosmetic container, which is configured so that in a process of releasing screw-coupling to a container main body by rotating a closing cap, by frictional force between an inner circumferential surface of a content inflow tube and an outer circumferential surface of a dropper pipe, the contents stored in the container main body pass through a content inflow hole forming a narrow channel, are dispersed, and are sucked into the dropper pipe, thereby allowing the contents to be drawn into the interior of the dropper pipe through a simple sucking structure to be used.

BACKGROUND ART

In general, as a method of using liquid contents, such as cosmetics including an eye cream, which are preferable to be used by the small quantity at a time and an accurate fixed quantity, a method of individually packing the liquid contents in the form of capsules and the like for each use amount has been traditionally used.

However, according to the individual packing method, the relatively large amount of contents is left inside the capsule even after a user uses the contents, so that there is a problem in that the individual packing method is extremely inefficient.

In order to overcome the problem of the individual packing method, there has been conceived a configuration in which the contents are accommodated in a container and then the contents are drawn out and used whenever a user uses the contents by using a drawing means having a general dropper or syringe structure, or a drawing means having a configuration of a push pump.

However, in the case of the drawing means having the general dropper structure, the amount sucked and drawn out is varied according to the degree of pressing, by a user, a compressing part made of rubber, so that there is a problem in that it is not easy to accurately draw out a certain amount of each time of use.

A dropper-type cosmetic container for solving the problem is disclosed in Korean Utility Model No. 20-0480441 (hereinafter, referred to as "Patent Document 1").

Patent Document 1 is characterized in that the dropper-type cosmetic container includes: a container main body 10 in which the contents are accommodated and an opening part 13 is formed at an upper end; a cap 20 which is coupled to the opening part 13 of the container main body 10 and is formed of an inner cap 21 and an outer cap 22; a pushing pocket 30 of which a part is inserted into the cap 20 and the other part protrudes from an upper portion of the cap 20; a push pipe 40 which is coupled to the pushing pocket 30 and is coupled to inner sides of the cap 20 and the pushing pocket 30 to be vertically movable; an elastic member 50 which is mounted to an external side of the push pipe 40; and a dropper pipe 60 which is coupled to the push pipe 40 and sucks and discharges the content accommodated in the container main body 10.

Patent Document 1 is configured to use a fixed quantity of contents only with a simple action of opening/closing the cap 20, but has the structure in which the push pipe 40 is formed in an upper portion of the dropper pipe 60 and the push pipe 40 is inserted into the interior of the pushing pocket 30, and sealing protrusions 31 are formed on an inner circumferential surface of the pushing pocket 30 that is in contact with the push pipe 40 to seal the inner side of the pushing pocket 30 and the push pipe 40, and in this state, when the cap 20 is opened by rotating the outer cap 22, the push pipe 40 moves down by the elastic member 50, so that the internal space of the pushing pocket 30 is widened, and thus the contents are sucked into the dropper pipe 60, so that the structure for sucking the contents is very complex, thereby causing problems in that it is not easy to assemble the cosmetic container, manufacturing time is increased, and cost of the container is increased.

DISCLOSURE

Technical Problem

The present invention is conceived to solve the problems, and an object of the present invention is to provide a dropper-type cosmetic container, which is configured so that in a process of releasing screw-coupling to a container main body by rotating a closing cap, by frictional force between an inner circumferential surface of a content inflow tube and an outer circumferential surface of a dropper pipe, the contents stored in the container main body pass through a content inflow hole forming a narrow channel, are dispersed, and are sucked into the dropper pipe, thereby allowing the contents to be drawn into the interior of the dropper pipe through a simple sucking structure to be used.

Technical Solution

A first exemplary embodiment of the present invention provides a dropper-type cosmetic container, including: a container main body in which contents are stored; a content inflow part which is coupled to an upper portion of the container main body, is extended into the container main body, and is provided with a content inflow tube formed with a content inflow hole at a lower end of the content inflow tube; and a dropper part which is detachably coupled to the upper portion of the container main body, and includes a closing cap which is screw-coupled to the container main body and is gripped by a hand of a user, a dropper pipe which is inserted into the content inflow tube, sucks the contents flowing into the content inflow tube, and is shaped like a pipe, and a compressing member which is coupled while surrounding an upper portion of the dropper pipe in an upper portion of the closing cap and discharges the contents sucked into the dropper pipe by pressing by the user, in which in a process of releasing the screw-coupling to the container main body by rotating the closing cap, by frictional force between an inner circumferential surface of the content inflow tube and an outer circumferential surface of the dropper pipe, the contents stored in the container main body pass through the content inflow hole, are dispersed, and are sucked into the dropper pipe.

Further, one or more air movement holes may be formed at an upper end of the content inflow part.

Further, a content sucking pipe may be coupled to a lower portion of the content inflow tube so as to suck the contents stored in the container main body.

A second exemplary embodiment of the present invention provides a dropper-type cosmetic container, including: a container main body in which contents are stored; a content inflow part which is coupled to an upper portion of the container main body, extended into the container main body, and is provided with a content inflow tube formed with a content inflow hole at a lower end of the content inflow tube; and a dropper part which is detachably coupled to the upper portion of the container main body, and includes a closing cap which is screw-coupled to the container main body and is gripped by a hand of a user, a dropper pipe which is inserted into the content inflow tube, sucks the contents flowing into the content inflow tube, and is shaped like a pipe, and a compressing member which is coupled while surrounding an upper portion of the dropper pipe in an upper portion of the closing cap and discharges the contents sucked into the dropper pipe by pressing of the user, in which a sucking guide protrusion which is in contact with an outer circumferential surface of the dropper pipe and induces the contents to flow into the content inflow tube when the dropper pipe moves up is provided at an inner side of the content inflow tube, and in a process of releasing the screw-coupling to the container main body by rotating the closing cap, by frictional force between the sucking guide protrusion and the outer circumferential surface of the dropper pipe, the contents stored in the container main body pass through the content inflow hole, are dispersed, and are sucked into the dropper pipe.

A third exemplary embodiment of the present invention provides a dropper-type cosmetic container, including: a container main body in which contents are stored; a content inflow part which is coupled to an upper portion of the container main body, extended into the container main body, and is provided with a content inflow tube formed with a content inflow hole at a lower end of the content inflow tube; and a dropper part which is detachably coupled to the upper portion of the container main body, and includes a closing cap which is screw-coupled to the container main body and is gripped by a hand of a user, a dropper pipe which is inserted into the content inflow tube, sucks the contents flowing into the content inflow tube, and is shaped like a pipe, and a compressing member which is coupled while surrounding an upper portion of the dropper pipe in an upper portion of the closing cap and discharges the contents sucked into the dropper pipe by pressing of the user, in which an auxiliary sucking pipe which is in contact with an outer circumferential surface of the dropper pipe and induces the contents to flow into the content inflow tube when the dropper pipe moves up is coupled to an upper portion of an inner side of the content inflow tube, and in a process of releasing the screw-coupling to the container main body by rotating the closing cap, by frictional force between an inner circumferential surface of the auxiliary sucking pipe and the outer circumferential surface of the dropper pipe, the contents stored in the container main body pass through the content inflow hole, are dispersed, and are sucked into the dropper pipe.

A fourth exemplary embodiment of the present invention provides a dropper-type cosmetic container, including: a container main body in which contents are stored; a content inflow part which is coupled to an upper portion of the container main body, extended into the container main body, and is provided with a content inflow tube formed with a content inflow hole at a lower end of the content inflow tube; and a dropper part which is detachably coupled to the upper portion of the container main body, and includes a closing cap which is screw-coupled to the container main body and is gripped by a hand of a user, a dropper pipe which is inserted into the content inflow tube, sucks the contents flowing into the content inflow tube, and is shaped like a pipe, and a compressing member which is coupled while surrounding an upper portion of the dropper pipe in an upper portion of the closing cap and discharges the contents sucked into the dropper pipe by pressing of the user, in which an auxiliary sucking pipe which is in contact with an outer circumferential surface of the dropper pipe and induces the contents to flow into the content inflow tube when the dropper pipe moves up is integrally molded with an upper portion of an inner side of the content inflow tube through double injection, and in a process of releasing the screw-coupling to the container main body by rotating the closing cap, by frictional force between an inner circumferential surface of the auxiliary sucking pipe and the outer circumferential surface of the dropper pipe, the contents stored in the container main body pass through the content inflow hole, are dispersed, and are sucked into the dropper pipe.

Advantageous Effects

As described above, according to the present invention, a dropper-type cosmetic container is configured so that in a process of releasing screw-coupling to a container main body by rotating a closing cap, by frictional force between an inner circumferential surface of a content inflow tube and an outer circumferential surface of a dropper pipe, the contents stored in the container main body pass through a content inflow hole forming a narrow channel, are dispersed, and are sucked into the dropper pipe, there is an advantage in that it is possible to draw the contents into the interior of the dropper pipe through a simple sucking structure and use the contents.

BEST MODE

Figure 1:
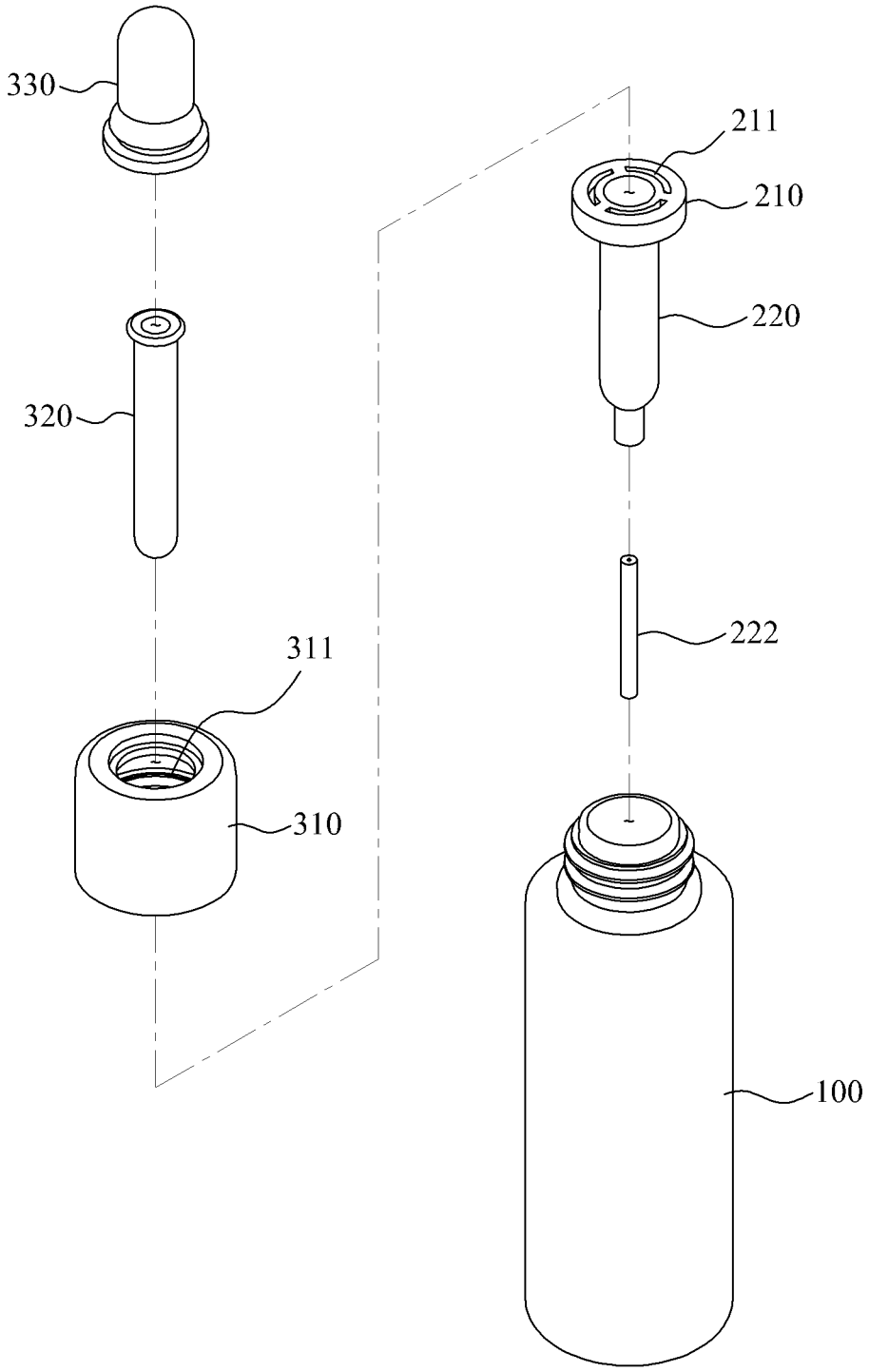
FIG. 1 is an exploded perspective view illustrating a configuration of a dropper-type cosmetic container according to a first exemplary embodiment of the present invention.

Hereinafter, the present invention will be described in detail with reference to the drawings. The same reference numeral presented in each drawing denotes the same member.

Figure 2:
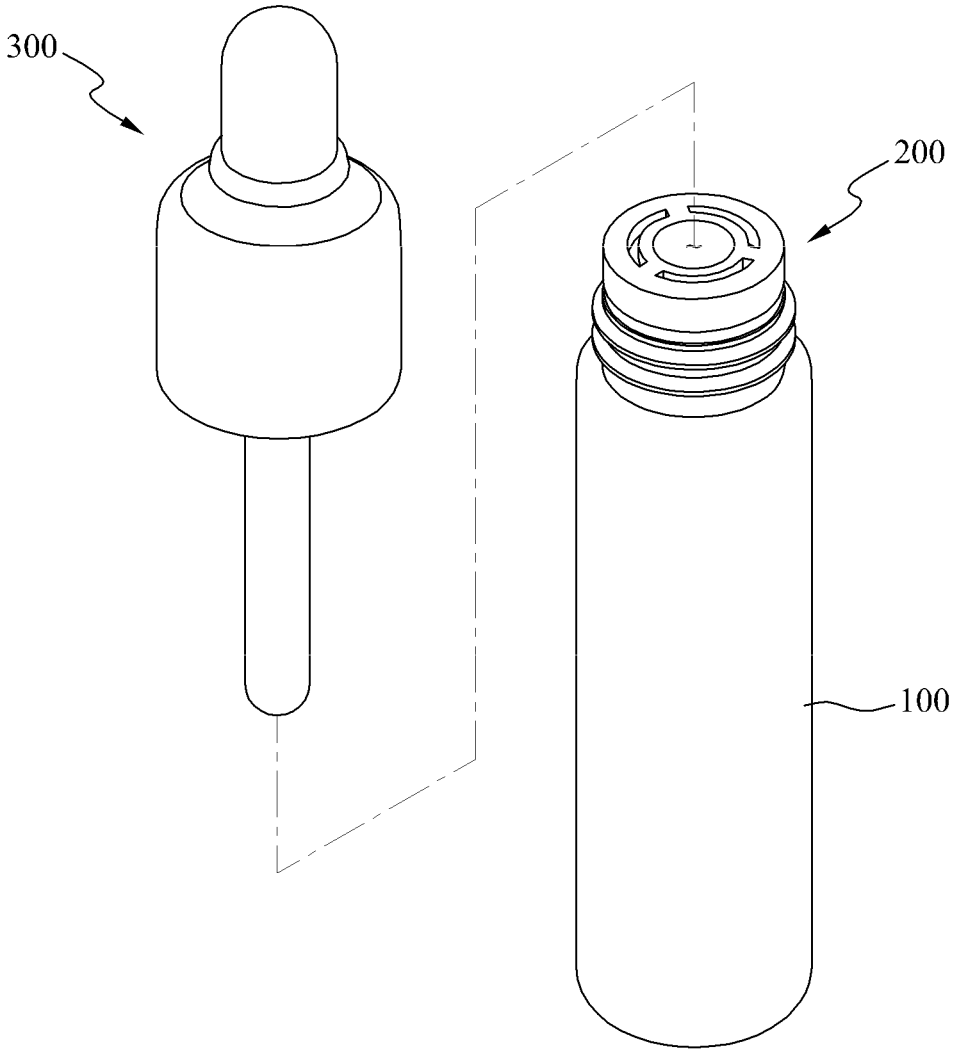
FIG. 2 is a perspective view of a coupling state of the configuration of the dropper-type cosmetic container according to the first exemplary embodiment of the present invention.
Figure 3:
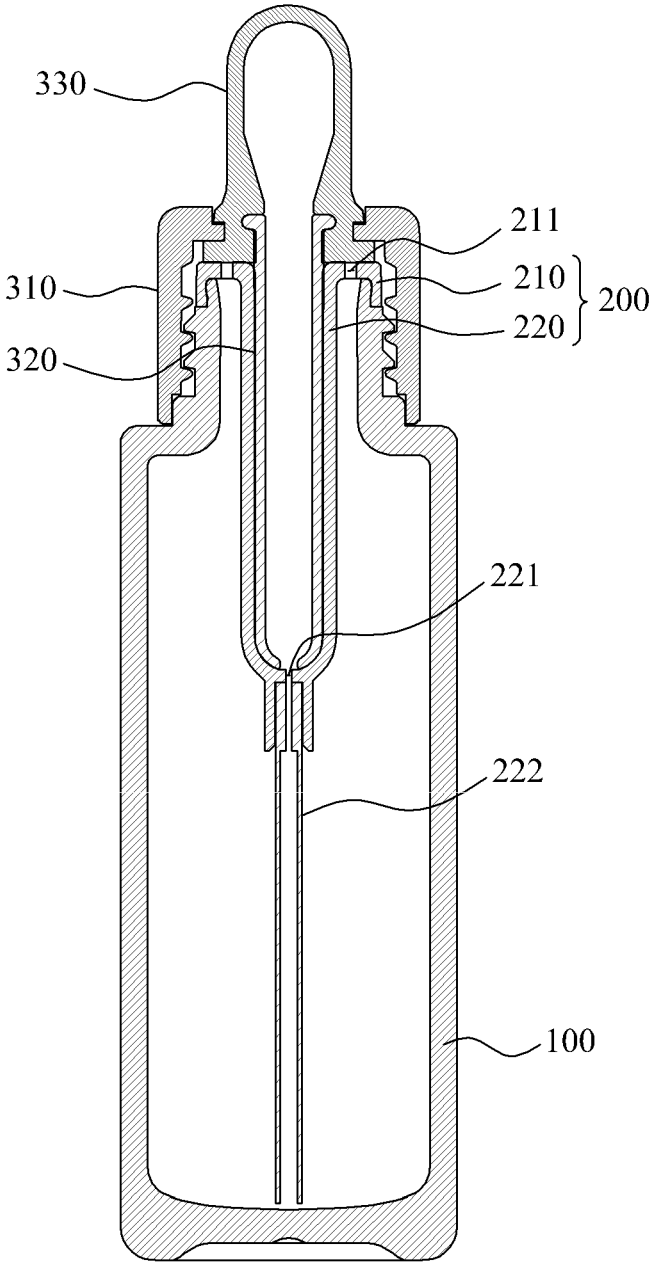
FIG. 3 is a cross-sectional view of a coupling state of the configuration of the dropper-type cosmetic container according to the first exemplary embodiment of the present invention.

FIG. 1 is an exploded perspective view illustrating a configuration of a dropper-type cosmetic container according to a first exemplary embodiment of the present invention, FIG. 2 is a perspective view of a coupling state of the configuration of the dropper-type cosmetic container according to the first exemplary embodiment of the present invention, and FIG. 3 is a cross-sectional view of a coupling state of the configuration of the dropper-type cosmetic container according to the first exemplary embodiment of the present invention.

Referring to FIGS. 1 to 3, the dropper-type cosmetic container according to the first exemplary embodiment of the present invention includes a container main body 100, a content inflow part 200, and a dropper part 300.

The container main body 100 stores the liquid contents, and an upper end of the container main body 100 is opened so that the container main body 100 is fillable with the contents, and a screw thread, which is screw-coupled to a closing cap 310 so that the dropper part 300 is detachable, is formed on an outer circumferential surface of an upper portion of the container main body 100.

The content inflow part 200 is coupled to the upper portion of the container main body 100, and the contents stored in the container main body 100 flow into the content inflow part 200, and the content inflow part 200 includes a seating part 210 and a content inflow tube 220.

The seating part 210 is seated while surrounding the upper portion of the container main body 100 and fixes the content inflow part 200 to the container main body 100, and one or more air movement holes 211 are formed at an upper end of the seating part 210, and the air movement hole 211 allows external air to flow into the container main body 100 when the dropper part 300 is detached from the container main body 100, and serves to discharge the air existing inside the container main body 100 to the outside when the dropper part 300 is coupled to the container main body 100.

The content inflow tube 220 is extended from the seating part 210 in a down direction and is inserted into the interior of the container main body 100, and a content inflow hole 221 is formed at a lower end of the content inflow tube 220 so that the content may flow into the content inflow tube 220.

In the present invention, the content inflow hole 221 forms a narrow channel so that the content stored in the container main body 100 may be dispersed in the process of the inflow of the contents stored in the container main body 100 into the content inflow tube 220, and to this end, a diameter of the content inflow hole 221 may be 0.5 mm to 1 mm.

When the contents stored in the container main body 100 have high viscosity, a diameter of the content inflow hole 221 may be slightly larger than 1 mm.

In the meantime, a content sucking pipe 222 is coupled to a lower portion of the content inflow tube 220 so as to suck the contents stored in the container main body 100, and by means of the content sucking pipe 222, it is possible to minimize the amount of remaining contents stored in the container main body 100.

The dropper part 300 is detachably coupled to the upper portion of the container main body 100 and draws out the contents stored in the container main body 100, and includes the closing cap 310 which is screw-coupled to the container main body 100 and is gripped by a hand of a user, a dropper pipe 320 which is inserted into the content inflow tube 220, sucks the contents flowing into the content inflow tube 220, and is shaped like a pipe, and a compressing member 330 which is coupled while surrounding the upper portion of the dropper pipe 320 in the upper portion of the closing cap 310, and discharges the contents sucked into the interior of the dropper pipe 320 by the press of the user.

A hollow hole 311 through which the compressing member 330 passes to be coupled is formed at a center portion of the closing cap 310.

The dropper part 300 is configured so that the contents stored in the container main body 100 flow into the content inflow pipe 220 by frictional force between an inner circumferential surface of the content inflow tube 220 and an outer circumferential surface of the dropper pipe 320, and in the present invention, when the contents stored in the container main body 100 flow into the content inflow pipe 220, the contents pass through the content inflow hole 221 forming the narrow channel and are dispersed in an upper direction to be sucked into the dropper pipe 320.

In the present invention, in the process of releasing the screw-coupling to the container main body 100 by rotating the closing cap 310, the contents are naturally sucked by the frictional force between the inner circumferential surface of the content inflow tube 220 and the outer circumferential surface of the dropper pipe 320, and the dropper pipe 320 sucking the contents which pass through the content inflow hole 221 and are dispersed is drawn out and then the contents sucked into the dropper pipe 320 are used by pressing the compressing member 330, so that it is possible to draw the contents into the dropper pipe 320 and use the contents through a simple sucking structure.

Figure 6:
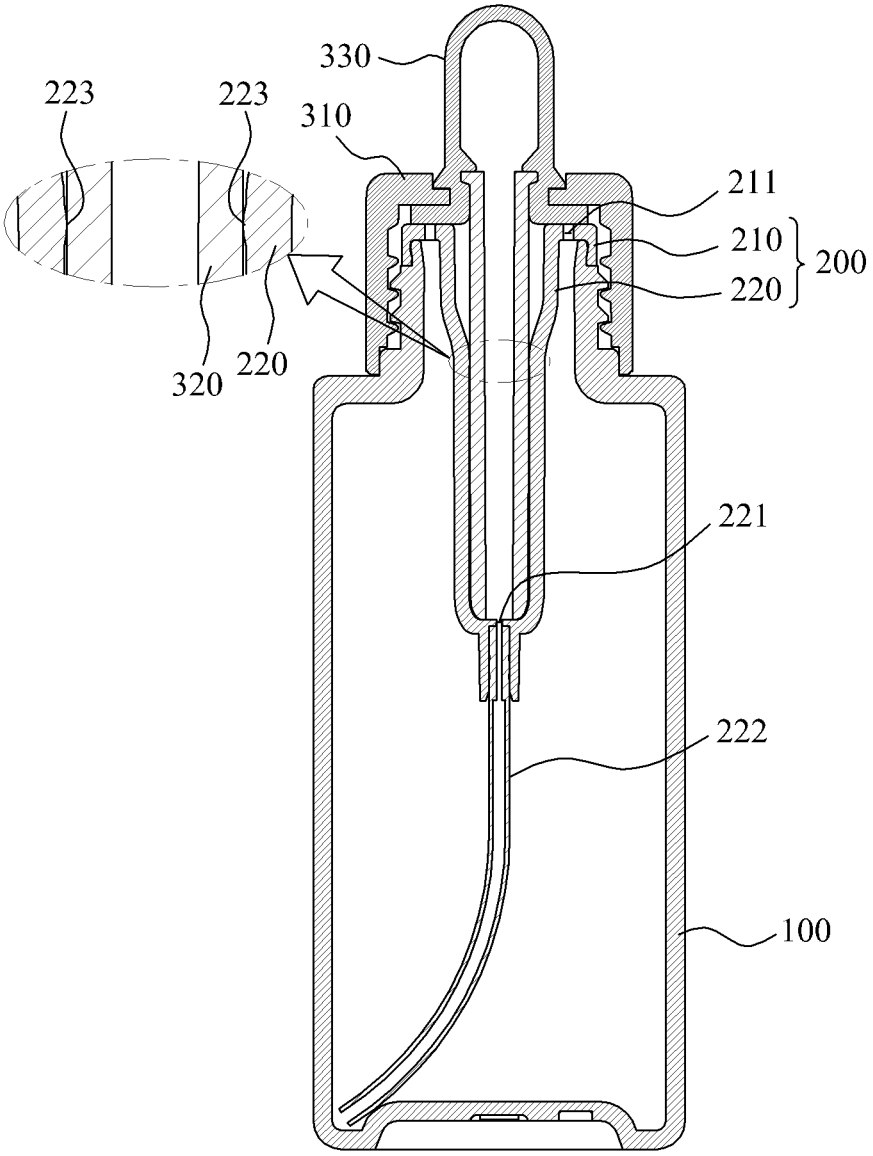
FIG. 6 is a cross-sectional view of a coupling state of a configuration of a dropper-type cosmetic container according to a second exemplary embodiment of the present invention.

In the meantime, referring to FIG. 6, a dropper-type cosmetic container according to a second exemplary embodiment of the present invention is characterized in that a sucking guide protrusion 223 protrudes while surrounding an inner circumferential surface of a content inflow tube 220, and the sucking guide protrusion 223 is configured so as to be in contact with an outer circumferential surface of a dropper pipe 320, thereby inducing the contents to flow into the content inflow tube 220 when the dropper pipe 320 moves up.

That is, the dropper-type cosmetic container according to the second exemplary embodiment of the present invention is characterized in that in a process of releasing the screw-coupling to a container main body 100 by rotating a closing cap 310, by frictional force between the sucking guide protrusion 223 and the outer circumferential surface of the dropper pipe 320, the contents stored in the container main body 100 pass through a content inflow hole 221 forming a narrow channel, are dispersed, and are sucked into the dropper pipe 320.

Figure 7:
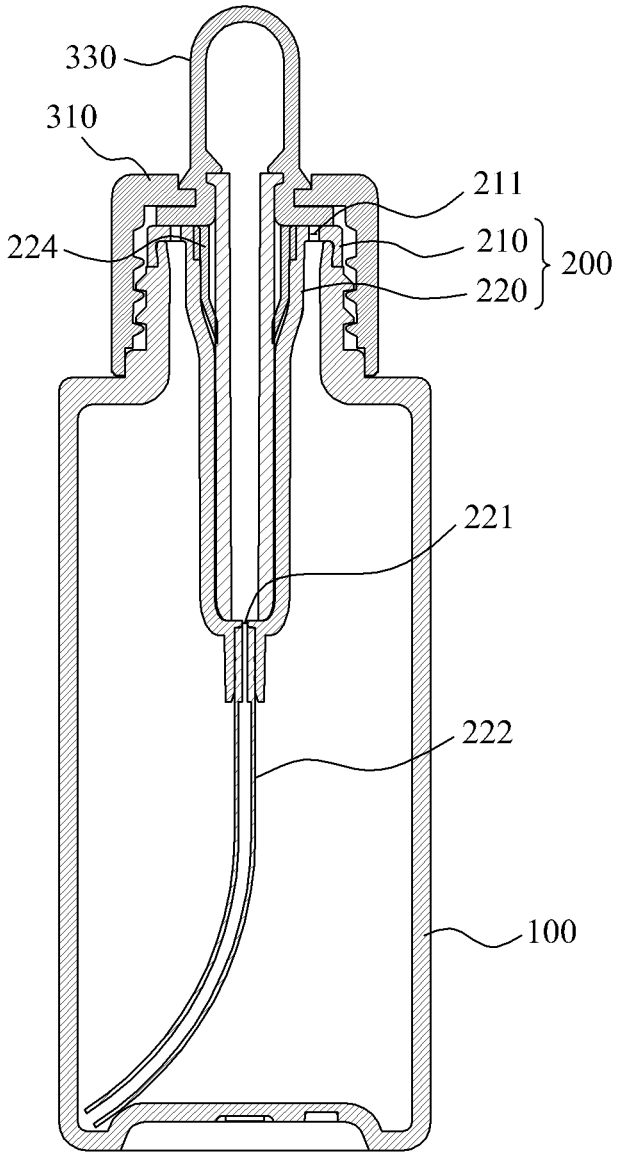
FIG. 7 is a cross-sectional view of a coupling state of a configuration of a dropper-type cosmetic container according to a third exemplary embodiment of the present invention.

In the meantime, referring to FIG. 7, a dropper-type cosmetic container according to a third exemplary embodiment of the present invention is characterized in that an auxiliary sucking pipe 224 is coupled to an upper portion of an inner side of a content inflow tube 220, and an inner circumferential surface of the auxiliary sucking pipe 224 is configured so as to be in contact with an outer circumferential surface of a dropper pipe 320, thereby inducing the contents to flow into the content inflow tube 220 when the dropper pipe 320 moves up.

That is, the dropper-type cosmetic container according to the third exemplary embodiment of the present invention is characterized in that in a process of releasing the screw-coupling to a container main body 100 by rotating a closing cap 310, by frictional force between the inner circumferential surface of the auxiliary sucking pipe 224 and the outer circumferential surface of the dropper pipe 320, the contents stored in the container main body 100 pass through a content inflow hole 221 forming a narrow channel, are dispersed, and are sucked into the dropper pipe 320.

Figure 8:
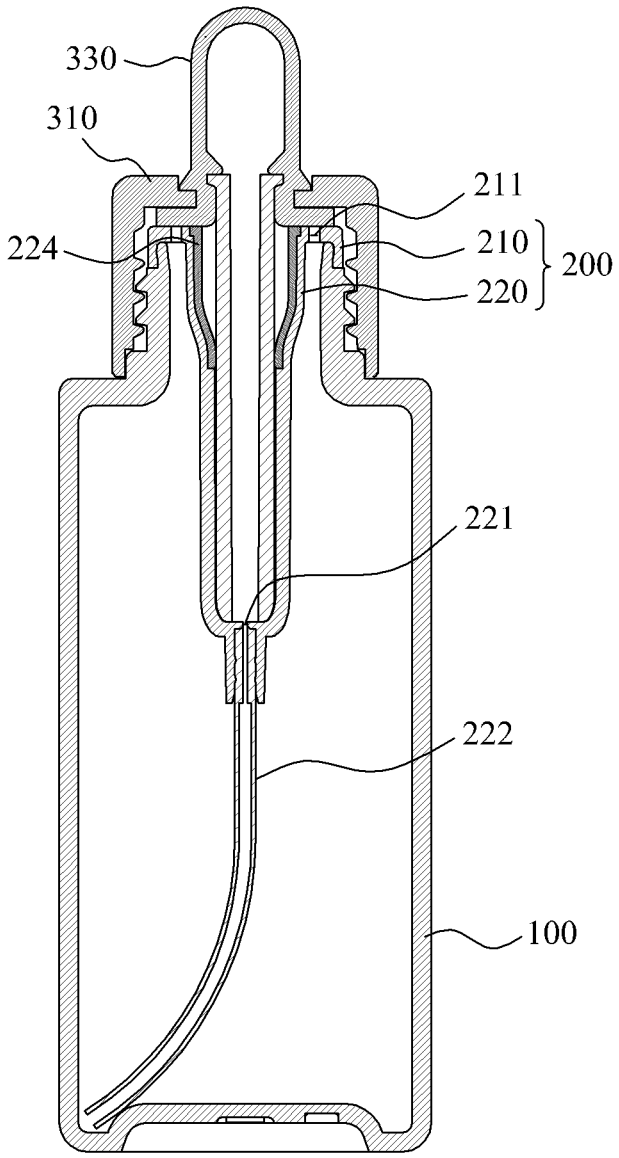
FIG. 8 is a cross-sectional view of a coupling state of a configuration of a dropper-type cosmetic container according to a fourth exemplary embodiment of the present invention.

In the meantime, according to a fourth exemplary embodiment of the present invention, an auxiliary sucking pipe 224 may be configured so that the auxiliary sucking pipe 224 is integrally molded with an upper portion of an inner side of a content inflow tube 220 through double injection as illustrated in FIG. 8.

The auxiliary sucking pipe 224 according to each of the third and fourth exemplary embodiments of the present invention may induce the contents to be sucked through the independent frictional force with the outer circumferential surface of the dropper pipe 320, and may be configured to perform a function of assisting the suction of the contents in the state where the content sucking structure according to the frictional force between the inner circumferential surface of the content inflow tube 220 and the outer circumferential surface of the dropper pipe 320 is maintained as it is.

Figure 4:
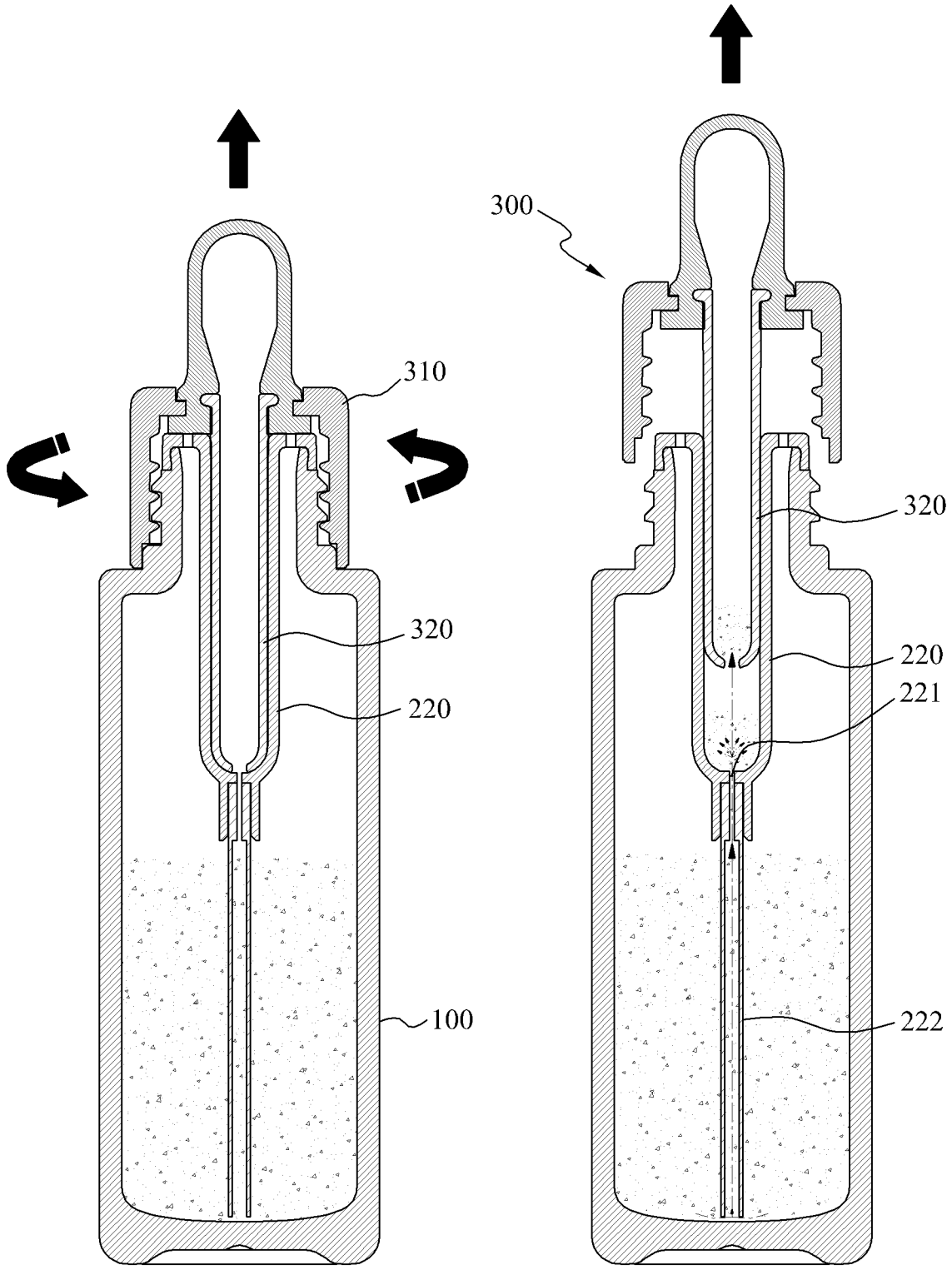
FIGS. 4 and 5 are diagrams illustrating a method of using the dropper-type cosmetic container according to the first exemplary embodiment of the present invention.

Hereinafter, a method of using the dropper-type cosmetic container of the present invention will be described with reference to FIGS. 4 and 5. First, referring to FIG. 4, when the screw-coupling to the container main body 100 is released by rotating the closing cap 310 to one side, the closing cap 310 moves up and thus the dropper part 300 is separated from the container main body 100, and in this case, frictional force is generated between the inner circumferential surface of the content inflow tube 220 and the outer circumferential surface of the dropper pipe 320 in a process in which the dropper pipe 320 coupled to the inner side of the closing cap 310 moves up together, and thus the contents stored in the container main body 100 pass through the content inflow tube 22 and flow into the content inflow tube 220 through the content inflow hole 221 by pressure generated inside the content inflow tube 220.

Figure 5:
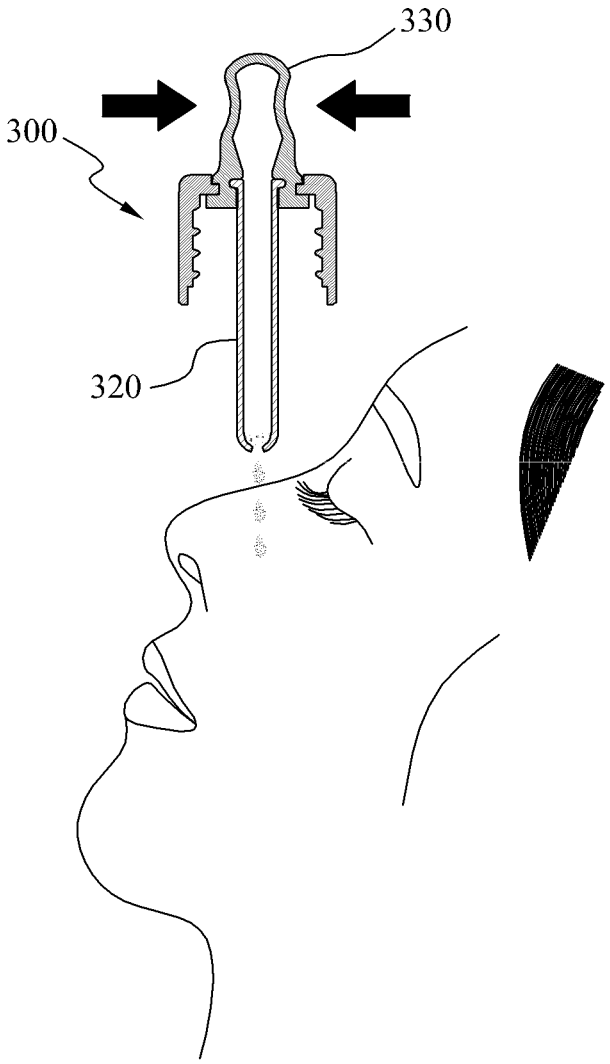

As described above, when the contents flow into the content inflow tube 220, the contents passing through the content inflow hole 221 are dispersed in the upper direction by the structure of the content inflow hole 221 forming the narrow channel, and thus the dropper part 300 is separated while the contents are sucked into the dropper pipe 320, and as illustrated in FIG. 5, the contents sucked into the dropper pipe 320 may be discharged by pressing the compressing member 330 of the dropper part 300 to be applied to the skin.

The optimum exemplary embodiments are disclosed in the drawings and the specification. Herein, the specific terms are used, but these are used only for the purpose of explaining the present invention, but are not used for limiting a meaning or restricting the range of the present invention described in the claims. Accordingly, those skilled in the art will understand that various modifications and other equivalent exemplary embodiments are possible. Accordingly, the true technical protection scope of the present invention will be defined by the technical spirit of the accompanying claims.

The invention claimed is:

1. A dropper-type cosmetic container, comprising:

a container main body in which contents are stored;

a content inflow part which is coupled to an upper portion of the container main body, is extended into the container main body, and is provided with a content inflow tube that is formed with a content inflow hole at a lower end of the content inflow tube and a content sucking pipe that is coupled to a lower portion of the content inflow tube and sucks the contents stored in the container main body;

a dropper part including a closing cap which is detachably coupled to the upper portion of the container main body, a dropper pipe which is inserted into the content inflow tube, sucks the contents flowing into the content inflow tube through the content sucking pipe, and is shaped like a pipe, and a compressing member which discharges the contents sucked into the dropper pipe by pressing by a user;

an upper portion of the closing cap surrounds and couples to the compressing member, and the compressing member surrounds and couples to an upper portion of the dropper pipe; and wherein the compressing member seals against the content inflow part when the closing cap is coupled to the upper portion of the container main body.

2. The dropper-type cosmetic container of claim 1, wherein one or more air movement holes are formed in the content inflow part.

3. The dropper-type cosmetic container of claim 1, wherein the contents stored in the container main body pass through the content inflow hole, are dispersed, and are sucked into the dropper pipe by frictional force between an inner circumferential surface of the content inflow tube and an outer circumferential surface of the dropper pipe in a process of releasing the container main body by rotating the closing cap.

4. The dropper-type cosmetic container of claim 1, wherein the content inflow part further includes a sucking guide protrusion which is provided at an inner side of the content inflow tube, is in contact with an outer circumferential surface of the dropper pipe, and induces the contents to flow into the content inflow tube when the dropper pipe moves up, and the contents stored in the container main body pass through the content inflow hole, are dispersed, and are sucked into the dropper pipe by frictional force between the sucking guide protrusion and the outer circumferential surface of the dropper pipe in a process of releasing the container main body by rotating the closing cap.

5. The dropper-type cosmetic container of claim 1, wherein the content inflow part further includes an auxiliary sucking pipe which is coupled to an upper portion of an inner side of the content inflow tube, is in contact with an outer circumferential surface of the dropper pipe, and induces the contents to flow into the content inflow tube when the dropper pipe moves up, and the contents stored in the container main body pass through the content inflow hole, are dispersed, and are sucked into the dropper pipe by frictional force between an inner circumferential surface of the auxiliary sucking pipe and the outer circumferential surface of the dropper pipe in a process of releasing the container main body by rotating the closing cap.

6. The dropper-type cosmetic container of claim 1, wherein the content inflow part further includes an auxiliary sucking pipe which is integrally molded with an upper portion of an inner side of the content inflow tube by double injection, is in contact with an outer circumferential surface of the dropper pipe and induces the contents to flow into the content inflow tube when the dropper pipe moves up, and the contents stored in the container main body pass through the content inflow hole, are dispersed, and are sucked into the dropper pipe by frictional force between an inner circumferential surface of the auxiliary sucking pipe and the outer circumferential surface of the dropper pipe in a process of releasing the container main body by rotating the closing cap.

7. The dropper-type cosmetic container of claim 1, wherein the closing cap is screw-coupled to the container main body and is gripped by a hand of the user.

8. A dropper-type cosmetic container, comprising:

a container main body in which contents are stored;

a content inflow part which is coupled to an upper portion of the container main body, is extended into the container main body, and is provided with a content inflow tube that is formed with a content inflow hole at a lower end of the content inflow tube and a content sucking pipe that is coupled to a lower portion of the content inflow tube and sucks the contents stored in the container main body;

a dropper part including a closing cap which is detachably coupled to the upper portion of the container main body, a dropper pipe which is inserted into the content inflow tube, sucks the contents flowing into the content inflow tube through the content sucking pipe, and is shaped like a pipe, and a compressing member which discharges the contents sucked into the dropper pipe by pressing by a user;

an upper portion of the closing cap surrounds and couples to the compressing member, and a groove in the compressing member surrounds and couples to an upper portion of the dropper pipe; and wherein the compressing member seals against the content inflow part when the closing cap is coupled to the upper portion of the container main body.

* * * * *